US010513040B2

(12) United States Patent
Hendricks

(10) Patent No.: US 10,513,040 B2
(45) Date of Patent: Dec. 24, 2019

(54) UTILITY KNIFE

(71) Applicant: MARTOR KG, Solingen (DE)

(72) Inventor: Jan Hendricks, Solingen (DE)

(73) Assignee: MARTOR KG, Solingen (DE)

( * ) Notice: Subject to any disclaimer, the term of this patent is extended or adjusted under 35 U.S.C. 154(b) by 0 days.

(21) Appl. No.: 15/927,470

(22) Filed: Mar. 21, 2018

(65) Prior Publication Data

US 2018/0333873 A1 Nov. 22, 2018

(30) Foreign Application Priority Data

May 17, 2017 (DE) ..... 10 2017 004 691

(51) Int. Cl.
*B26B 11/00* (2006.01)
*B26B 5/00* (2006.01)

(52) U.S. Cl.
CPC ..... *B26B 11/00* (2013.01); *B26B 5/00* (2013.01)

(58) Field of Classification Search
CPC ..... B26B 11/00; B26B 5/00; B26B 29/02; B26B 27/00; B26B 5/005; B26B 5/006; B26B 27/005
USPC ..... 30/287, 299
See application file for complete search history.

(56) References Cited

U.S. PATENT DOCUMENTS 5,890,290 A * 4/1999 Davis ..... B26B 5/003 30/162
6,453,559 B1 * 9/2002 Marshall ..... B26B 27/005 30/152
6,560,873 B1 * 5/2003 Ortner ..... B26B 5/00 30/2
6,729,028 B1 * 5/2004 Hsu ..... B26B 1/044 30/143
D575,613 S * 8/2008 Jennings ..... D8/98
2015/0360374 A1 * 12/2015 Gringer ..... B26B 5/005 30/125
2017/0368698 A1 * 12/2017 Huang ..... B26B 1/02
2018/0319029 A1 * 11/2018 Marinovich ..... B26B 29/02
2018/0333873 A1 * 11/2018 Hendricks ..... B26B 5/00

FOREIGN PATENT DOCUMENTS

DE 20309701 U 10/2003
EP 3 403 777 A1 * 11/2018

OTHER PUBLICATIONS

English translation of DE 203 09 701 U1, Oct. 2003.*

* cited by examiner

*Primary Examiner* — Hwei-Siu C Payer
(74) *Attorney, Agent, or Firm* — Andrew Wilford

(57) ABSTRACT

A knife has a body forming a cavity, a blade with a cutting edge, and a holder forming a tool seat and movable relative to the knife body between an operating position with the tool seat in the cavity and a change position with the tool seat outside the cavity. An additional tool has at least two working parts and is provided with a holding part that can be fitted to the tool seat such that, in the operating position of the holder, one of the working parts is in a working position in which it projects from the body and can be used by a user while the other working part is in a stowed position inaccessible in the cavity and, in the change position, the tool is entirely outside the body and can be separated from the seat.

11 Claims, 6 Drawing Sheets

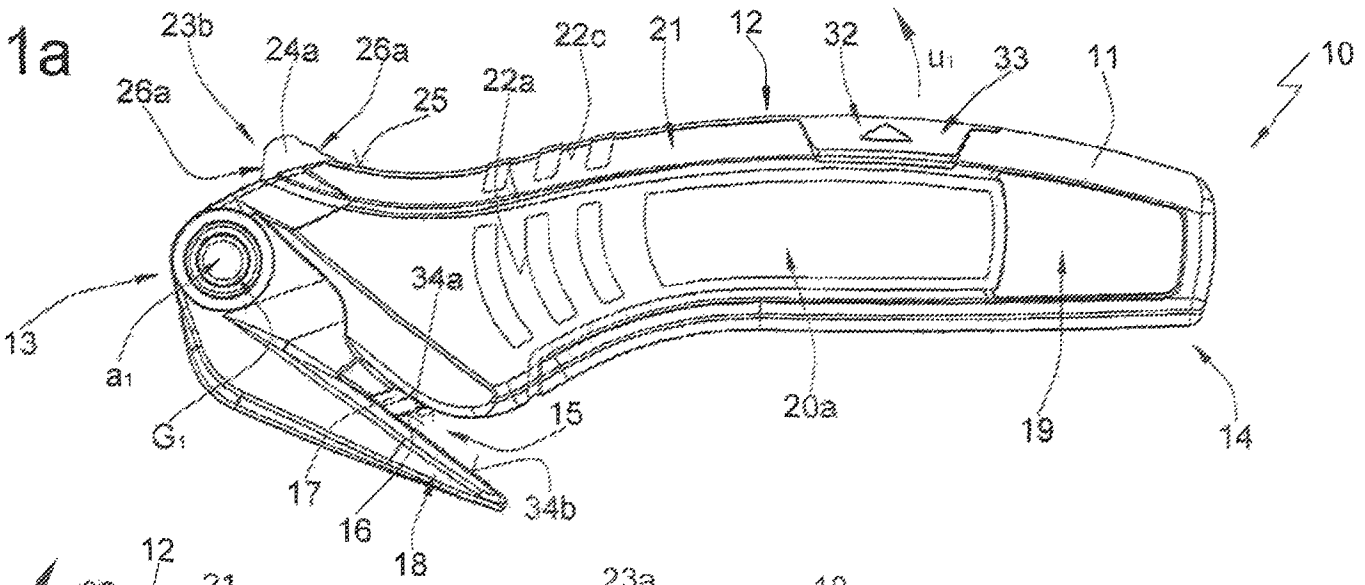
Fig. 1a
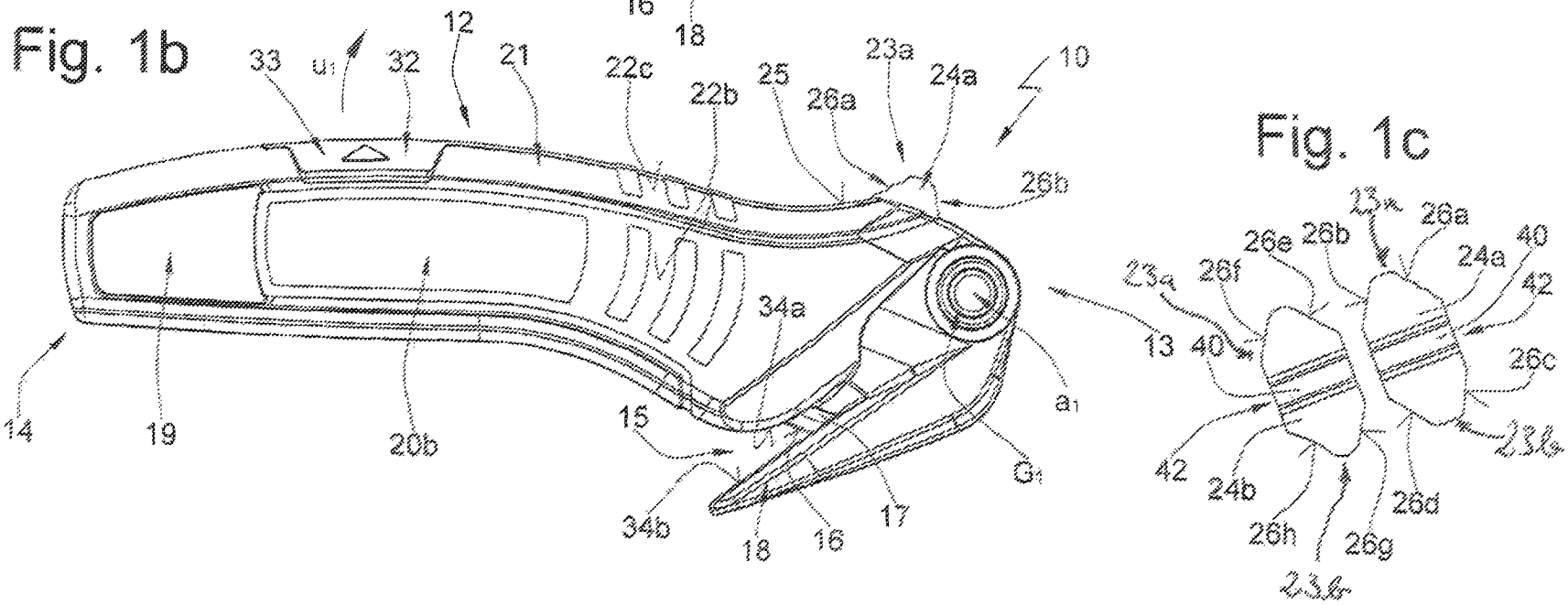
Fig. 1c
Fig. 1b

UTILITY KNIFE

FIELD OF THE INVENTION

The invention relates to a utility knife.

BACKGROUND OF THE INVENTION

Such a knife is of known type from established prior use. It comprises a sharp knife blade intended for the cutting of the material to be cut. Furthermore, the knife comprises a further blunt tool that projects beyond an outer edge of the knife body and is used, for example, for scoring adhesive tape.

The knife described in DE 203 09 701 has a blade that is recessed relative to an outer edge of the housing, together with a metal tongue projecting beyond the outer edge. A section of the tool head forms a flap that can be opened to release the metal tongue or blade. When the flap is open, the blade or metal tongue can be released from its respective seat, and can, for example, be replaced. The flap can then be closed once again, so that the blade and the metal tongue are held between the flap and a contact surface of the tool head. Unintentional opening of the flap is prevented by a screwed joint.

OBJECT OF THE INVENTION

It is an object of the invention to provide a knife that can be used in a more versatile manner.

SUMMARY OF THE INVENTION

The inventive knife comprises a knife body on which is mounted at least one blade with a cutting edge. The cutting edge is oriented, for example, such that it is recessed with respect to an outer surface of the knife body. An additional tool is detachably held on the knife body. The tool has at least two working parts. It can also have, for example, three or four working parts.

The tool is provided with a holding part that, in at least two relative positions, can be brought into engagement with a seat of a tool seat of the knife body. Optionally, one of a plurality of working parts of the tool can be arranged in a working position in which it can be used by a user, while the other working part is in a stowed position.

In the working position, the working part projects beyond the outer edge of the knife body such that a cutting process can be executed. For example, in the working position, the working part projects beyond an outer surface of the knife body.

By altering the position of the tool relative to the knife body, for example, one of a plurality of identical or different edge geometries and/or different edge sharpnesses can be brought into a working position. Here the edge geometries and edge sharpnesses can be optimized for particular items that are to be cut. If at least two working parts have scoring edges with the same edge geometry and edge sharpness, then, for example, after a working part has worn another working part that has the same parting characteristic can be moved into the working position.

The tool is, for example, designed as a sheet metal part. It is, for example, produced by a punching operation and a subsequent forming process.

The working parts are, for example, each provided with at least one scoring edge. For the purposes of the invention, the term scoring edge designates any edge that is suitable for parting or scoring the material that is to be cut. The scoring edge is, for example, a blunt edge.

The working part comprises, for example, at least one flat or undulatory scoring edge. The working part is, for example, designed in the shape of an arrowhead or a semicircle. Two scoring edges are, for example, arranged opposite one another with respect to a longitudinal axis of the tool. Two scoring edges of a working part are, for example, arranged such that they are parallel or at an acute angle to one another. Two scoring edges can, for example, merge into a rounded curve that forms an end of the tool. The scoring edge is, for example, arranged such that a parting process is possible by a pulling or pushing movement of the knife when it is held by the handle. That is to say, one scoring edge, for example, faces forward in the longitudinal direction of the knife, and one scoring edge, for example, faces rearward in the longitudinal direction.

Two working parts are for example, arranged opposite one another. If one working part is to be replaced by another working part, this can, for example, occur by way of a 180° rotation of the tool. In accordance with one alternative, for example, a total of four working parts can be provided on the tool, wherein in each case two working parts are located opposite one another. In this case the working parts are arranged, for example, in the form of a cross. The working parts are, for example, arranged offset by 90° or by 120°.

The working part is, for example, arranged so that it is inaccessible in a cavity of the knife body when it is located in a stowed position. For example, the working part can be moved into the cavity or out of the cavity by a movable holder on which the tool is mounted.

In accordance with one embodiment, all working parts can be arranged in the stowed position at the same time. If, for example, it is desired that no working part be arranged in the working position, the tool can be positioned relative to the seat such that all working parts are in the stowed position. In this case, for example, no working part projects beyond the outer edge of the knife body.

One embodiment of the invention is characterized in that the holding part has a projection that can be brought into a form fit engagement with a recess of the seat. The projection has, for example, the shape of a crimp or a pot-like indentation. The recess has, for example, the shape of a groove.

In accordance with another embodiment of the invention, the tool is held in the working position between a contact surface of the tool seat and a retaining surface of a cover. The cover is, for example, designed in the form of a flap. The flap is, for example, mounted such that it can pivot on a holder. The tool and the blade are, for example, stored on the holder. The tool and the blade can be held, for example, between the flap and the holder. With the flap it is possible to create a substantially flat outer surface that, with the movement of the holder relative to the housing, allows a sliding movement between the holder and the housing. The flap is, for example, formed from a plate. The plate can, for example, be detachably secured to the holder with a latch, such as a screw fastening, a catch mechanism, etc.

The tool seat is, for example, assigned to a holder that can be moved relative to the knife body. The holder is, for example, held such that it can pivot on the knife body. In accordance with an alternative embodiment, the holder can be moved in translation relative to the knife body. The holder can, for example, be moved between a blade-change position and an operating position. In the blade-change position, the tool can be removed from the holder and brought into a different position relative to the holder. For example, another working part can be brought into the working position. In the operating position, a scribing operation can be executed with a working part located in the working position. The other working parts are arranged in the standby position.

BRIEF DESCRIPTION OF THE DRAWING

Further advantages ensue from an embodiment illustrated in the schematic figures. Here:

FIG. 1*a* is a side view of a first side of the knife, where a holder is in the working position, FIG. 1*b*, based on FIG. 1*a*, is a side view of a second side of the knife located opposite to the first side, FIG. 1*c* is a plan view of two tools with working parts of different designs.

SPECIFIC DESCRIPTION OF THE INVENTION

Figure 2:
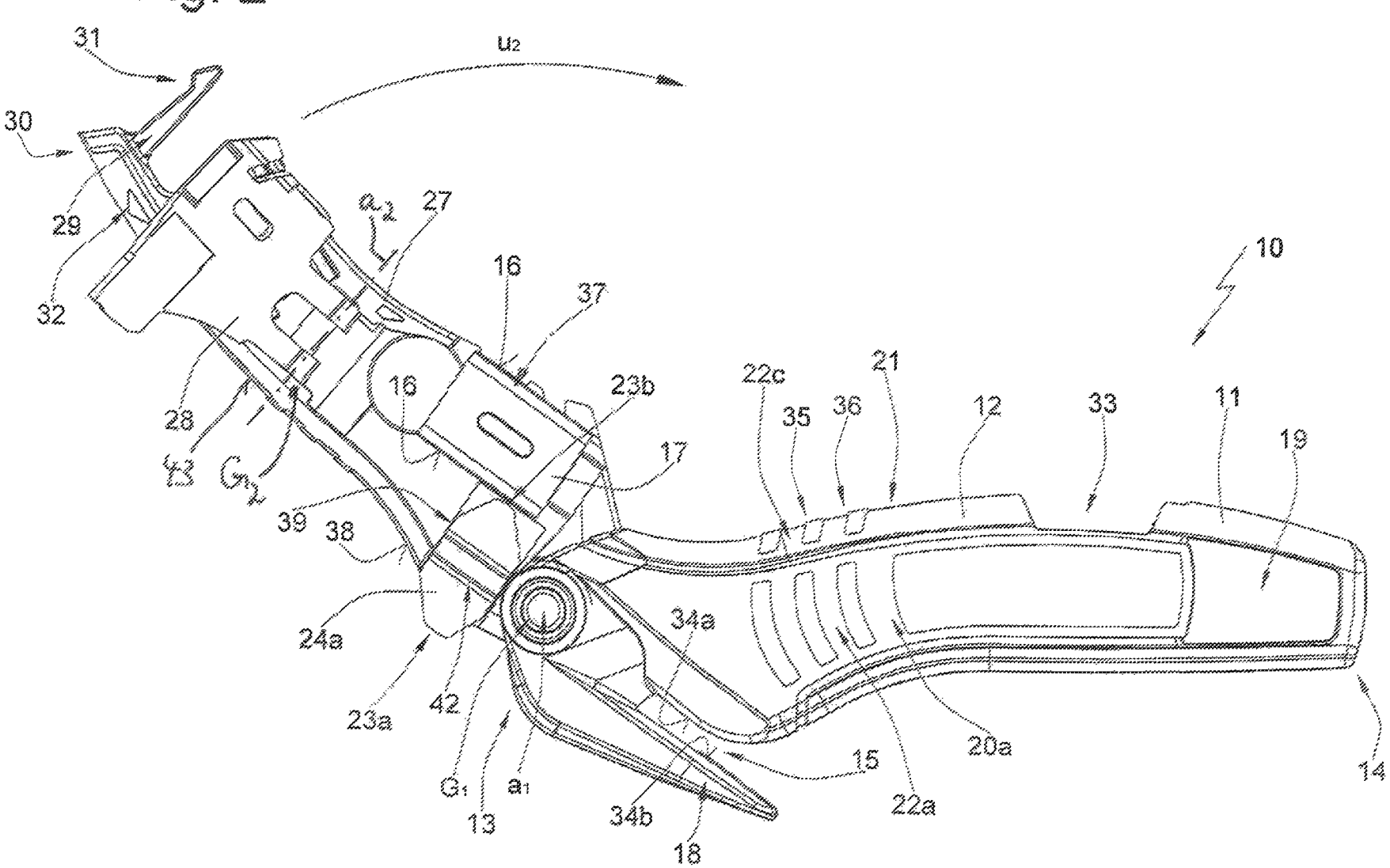
FIG. 2 is a side view in accordance with FIG. 1, where the holder is in a blade-change position, and a blade flap is located in an open position.

The knife as a whole is indicated by the reference symbol 10 in the figures. Like reference symbols in the various figures indicate corresponding parts, even if small letters are added or omitted.

A side view of the blade 10 is shown in FIG. 1*a*. The knife 10 comprises a knife body 11 with a grip 12, a front end 13 and a rear end 14. The knife 10 can be held at the grip 12.

The knife body 11, has a recess 15 is provided in the form of a notch. The recess 15 can guide the material to be cut to the cutting edge 16 of a blade 17. The recess 15 limits access to the cutting edge 16, for example, such that the user's fingers cannot come into contact with the cutting edge 16 via the opening 15. The recess 15 is formed between opposite guide surfaces 34*a* and 34*b* of the front end 13, the guide surface 34*b* being associated with a hook-shaped extension 18 of the knife body 11. The cutting edge 16 is oriented such that it is recessed with respect to an outer surface 25 of the knife body 11.

At the rear end 14, the blade body 11 is provided with a through hole 19 that can, for example, be used to hang up the knife 10. To avoid any slippage of the fingers, the housing 11 is provided on two opposite sides 20*a* and 20*b* and on the knife back 21 with textured formations 22*a*, 22*b* and 22*c*.

On the front end 13, a working part 23*a* of a tool 24*a* projects beyond the outer surface 25 of the knife body 11. In the present embodiment the working part 23*a* has scoring edges 26*a* and 26*b*. The scoring edges 26*a* and 26*b* are set at an angle relative to a longitudinal axis m1 of the knife body 11. The tool 24*a* can be detached from the knife body 11 as will be explained below.

In FIG. 1*a*, the side 20*a* of the knife 10 is shown. FIG. 1*b* shows the knife from a side 20*b* opposite the side 20*a*.

In FIG. 1*c*, two tools 24*a* and 24*b* are shown that belong to a set of different tools 24. The tools 24*a* and 24*b* are provided with different scribing edges 26*a*, 26*b*, 26*c*, 26*d*, 26*e*, 26*f*, 26*g*, 26*h*. One of the tools 24*a* or 24*b* can be exchanged for the tool 24*a* in the knife body 11.

The knife body 11 has a recess 33 that extends along a knife back 21 on the two opposite sides 20*a* and 20*b* of the knife body 11. The knife back 21 is provided with a slot-shaped opening 35 connected to a cavity 36 of the housing 11 (which can, for example, be seen in FIG. 3*b*). The opening 35 allows pivoting of a holder 27 through the cavity 36 into the operating position, and out of the cavity 36 into the blade-change position (see FIGS. 2 and 3). An actuating part 32, which in the operating position fits in the recess 33, is formed on an end 30 of the holder 27. FIG. 2 shows that the tool 24*a* is held on the holder 27. In accordance with an alternative embodiment, the tool 24*a* could also be held directly on the housing 11. The blade 17 is also mounted on the holder 27. The holder 27 is mounted on the knife body 11 such that it can pivot between the blade-change position illustrated in FIG. 2 and the operating position illustrated in FIG. 1. A pivot G1 is formed between the holder 27 and the knife body 11, with a pivot axis a1. The holder 27 can be pivoted relative to the knife body 11, about the pivot axis a1 in direction u1 and out of the operating position into the blade-change position. The holder 27 can be pivoted about the pivot axis a1 in the direction u2, out of the blade-change position into the operating position.

Furthermore, an arm 29 can be seen in FIGS. 2 and 3 that is located on the end 30 of the holder 27 facing away from the pivot axis a1. The arm 29 is part of a latch 31. The arm 29 is provided with first latch formations that interact with second latch formations of the knife body 11. In the present embodiment, the arm 29 has a hook-shaped end that interacts with a mating structure, not shown, on the knife body 11.

Furthermore, on the end 30 in FIG. 2 the actuating part 32 can be seen, by way of which the holder 29 can be moved between the operating position and the blade-change position. In the operating position, the holder 27 is arranged completely in the cavity 36, so that the holder 27 can be actuated only from the outside by way of the actuating part 32.

As shown in FIG. 2, a first blade seat 37 for the blade 17 provided for cutting is formed on the holder 27. Adjacent to an upper edge 38 of the holder 27, a tool seat 39 is also formed for the tool 24*a*. Furthermore, in a rear section of the holder 27, at a spacing from the pivot axis a1, a seat 51 is formed for at least one replacement blade 50.

As shown in FIG. 2, the blade 17 and the tool 24*a* are held between the holder 27 and a cover 28. The holder 27 and the cover 28 form a pivot G2 with a pivot axis a2, and can pivot about the pivot axis a2 between the open position shown in FIG. 2, and a closed position illustrated in FIG. 3. In the open position, the tool 24*a* can be removed from the tool seat 39 of the holder 27, and can be reinserted or replaced in the tool seat 39 in a different position relative to the holder 27.

Figure 3A:
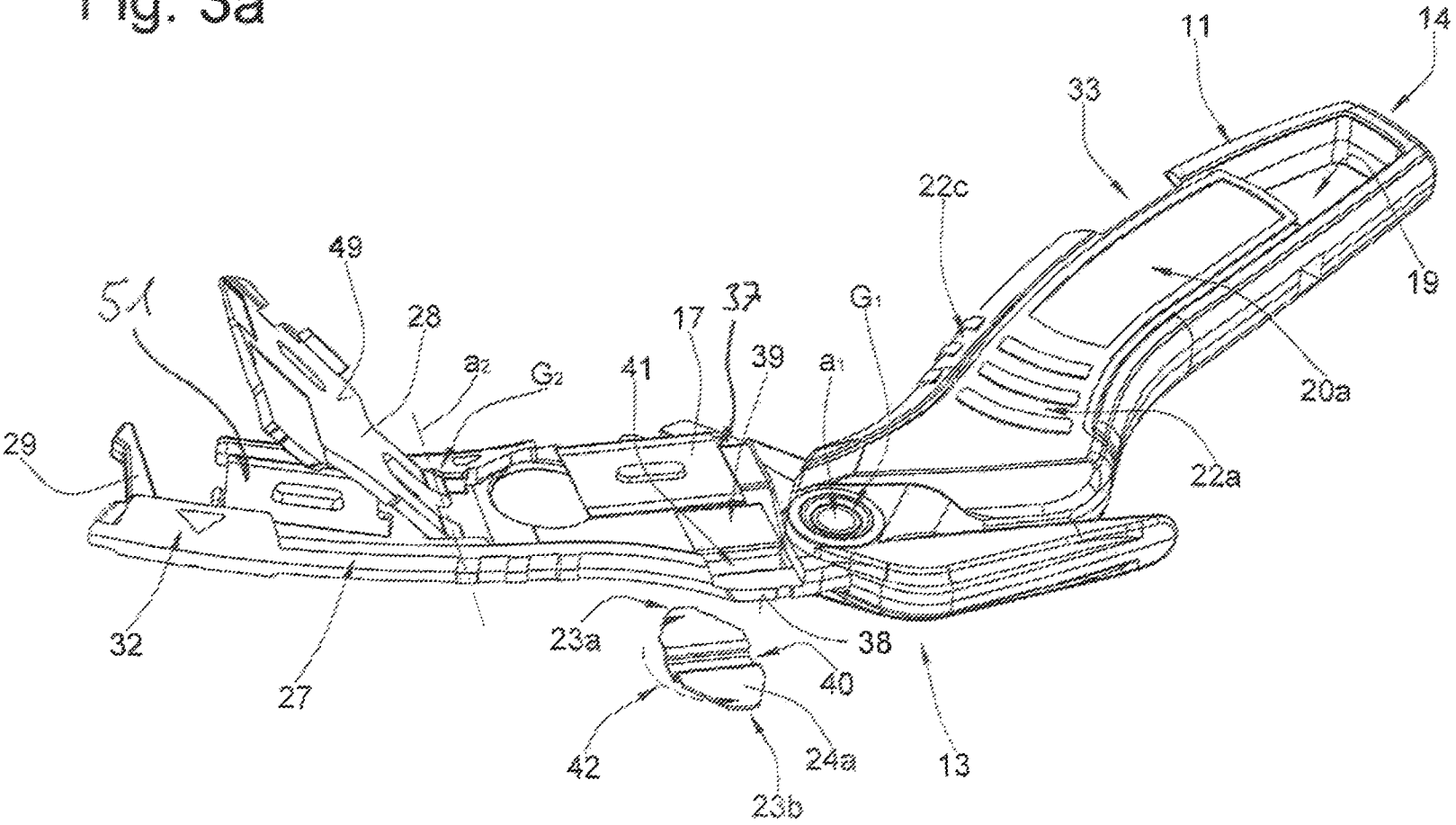
FIG. 3*a* is a perspective a frontal view of the knife as shown in FIG. 2.
Figure 3B:
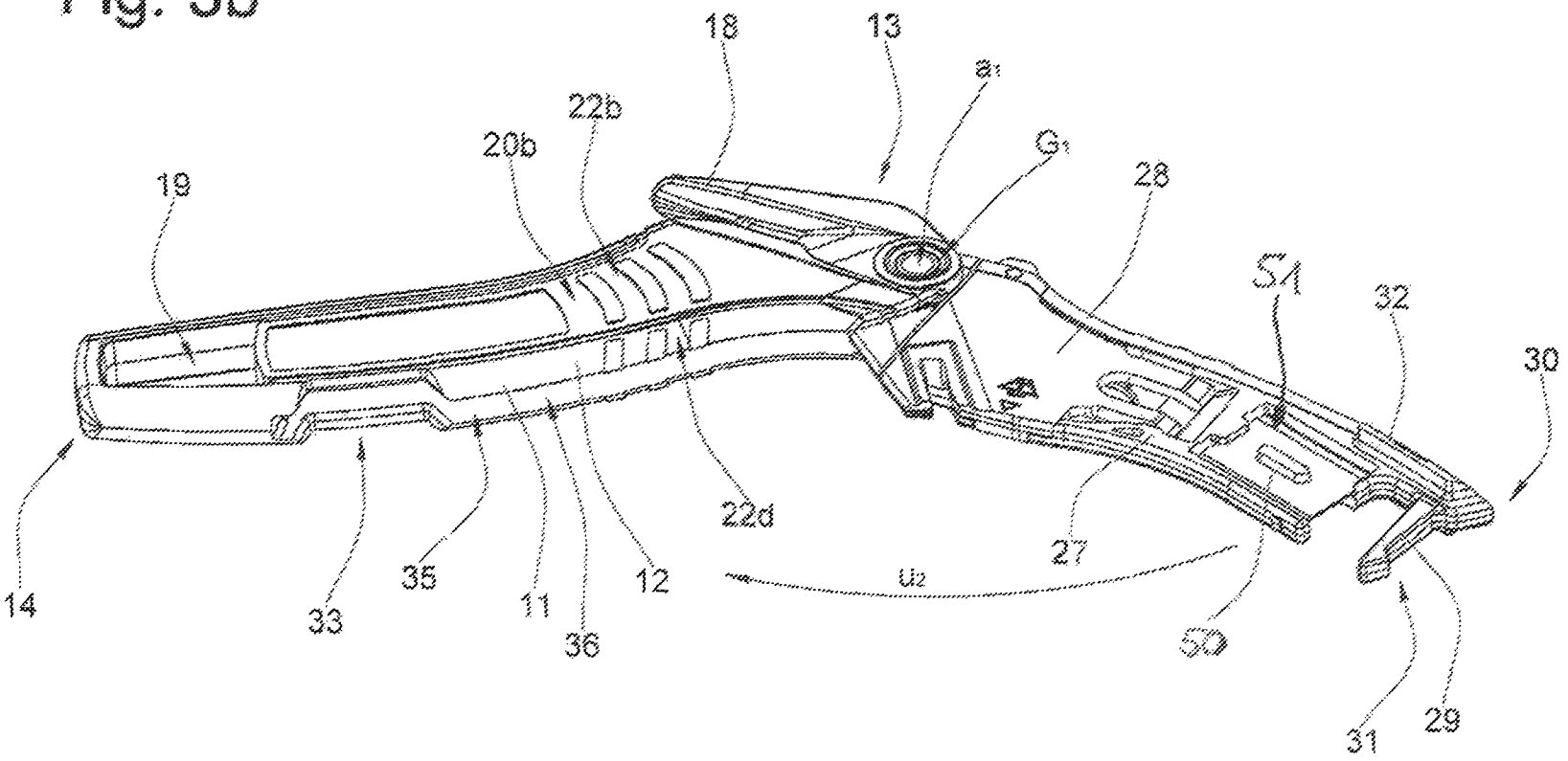
FIG. 3*b* is in perspective a rearward view of the knife as shown in FIG. 2.

FIGS. 2 and 3*a* show that the tool is provided on a holding part 42 with a projection 40 in the form of a U-shaped crimp; this is provided for positive retention of the tool 24*a* in the tool seat 39. The projection 40 extends across the entire width of the tool 24*a*. The tool seat 39 has a recess 41 formed complementarily to the projection 40 of the holder 27.

In addition, FIGS. 2 and 3*a* show that the tool has, in addition to the working part 23*a*, a further working part 23*b*. The parts 23*a* and 23*b* are separated from one another by the projection 40. The scoring edges 26*a* and 26*b* on the part 23*a*, and additional scoring edges 26*c* and 26*d* are on the part 23*b* of the tool 24*a*.

Figure 5:
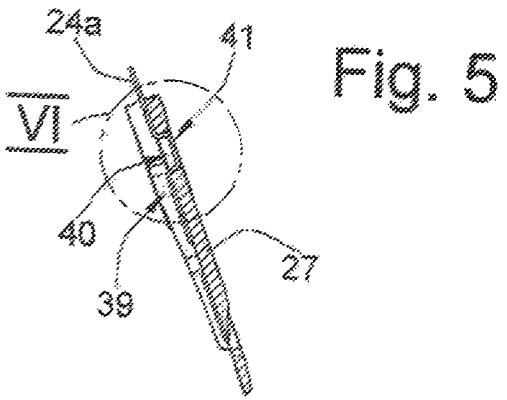
FIG. 5 is a cross-sectional view along the line of cut V-V in FIG. 4.
Figure 6:
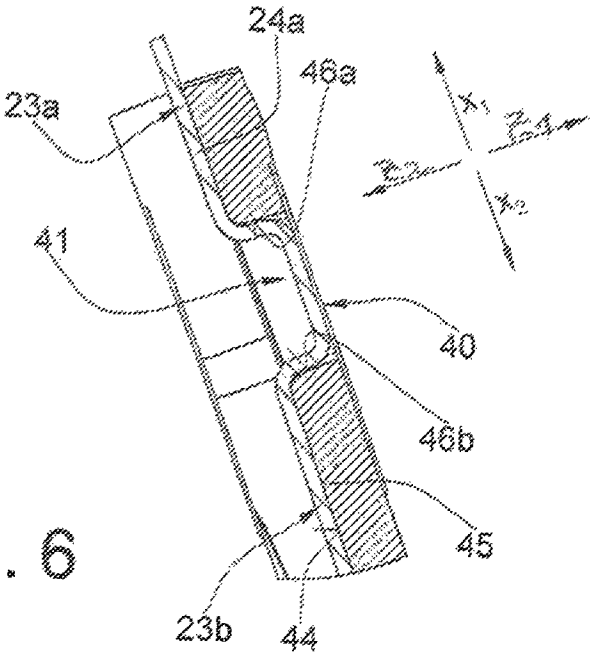
FIG. 6 is a detail view along section line VI of FIG. 5.
Figure 4:
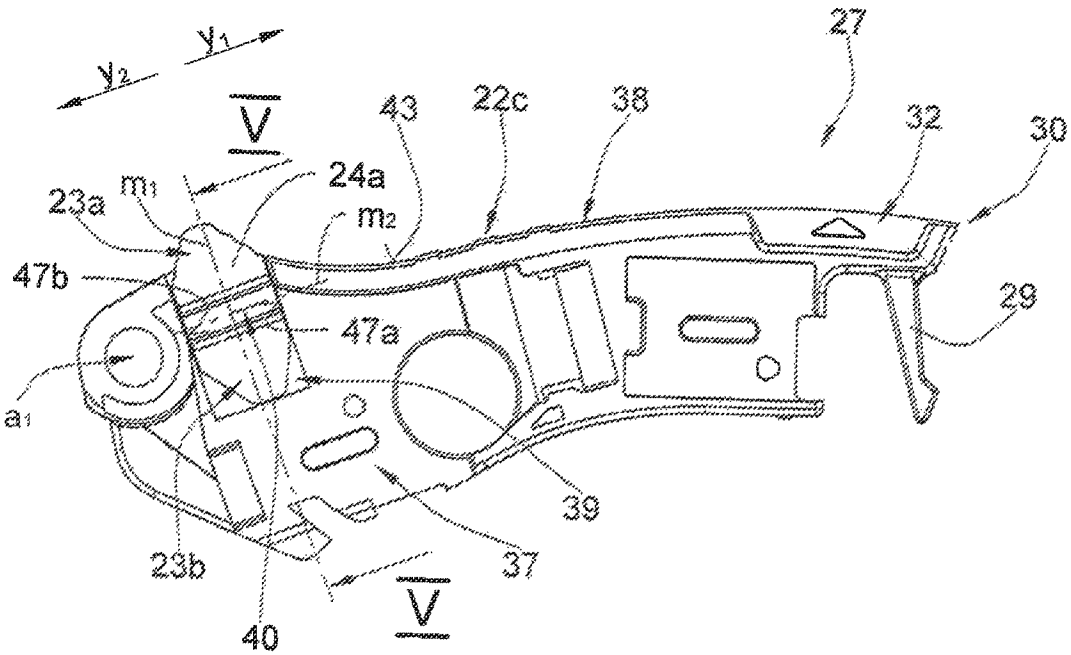
FIG. 4 is a side view of the holder without the cover.

In FIGS. 4, 5 and 6, the tool seat 39 is shown with the tool 24*a* mounted therein. The cover 28 is not shown in FIGS. 4, 5 and 6. As shown in FIG. 4, the section 23*a* projects beyond an outer surface 43 that, in the closed position of the holder 27, forms part of the outer surface 25, together with a section of the knife back 21. The section 23*b* bears fully against a surface 44 of the holder 27, such that in the closed position it is in the cavity 36.

In FIG. 4, a line of cut is shown that extends along a longitudinal axis m1 of the tool 24*a*. FIG. 4 shows that a longitudinal axis m2 of the projection 40 extends approximately at right angles to the longitudinal axis m1. The scoring edges of at least one working part are, for example, opposite one another with respect to the longitudinal axis m1. In FIGS. 5 and 6 it can be seen that a lower surface 45 of the tool 24*a* bears against the surface 44, and that the projection 40 fits in the recess 41. Opposite side walls 46*a* and 46*b* of the recess 41 prevent movement of the tool 24*a* in the x1 and x2 parallel to the longitudinal axis m1, and opposite side walls 47*a* and 47*b* prevent movement of the tool 24*a* in directions y1 and y2 transverse to the longitudinal axis m1.

Figure 8:
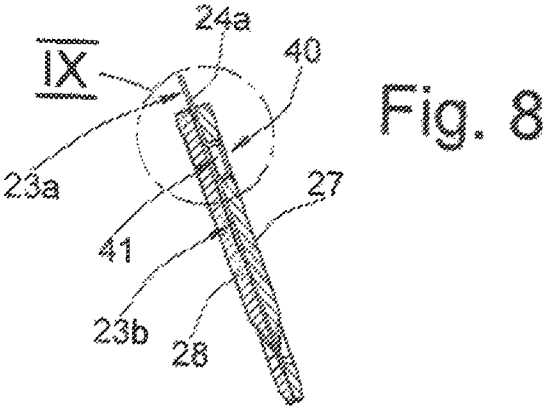
FIG. 8 is a cross-sectional view along section line VIII-VIII in FIG. 7.
Figure 9:
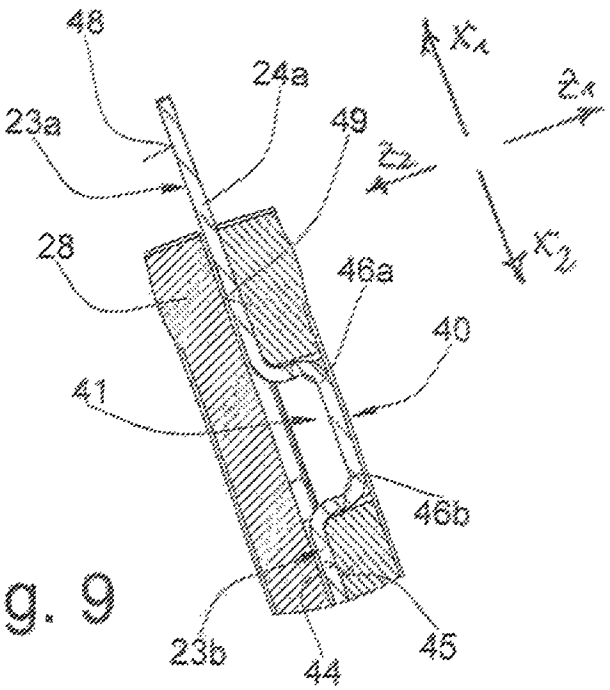
FIG. 9 is a detail view along section line IX in FIG. 8.
Figure 7:
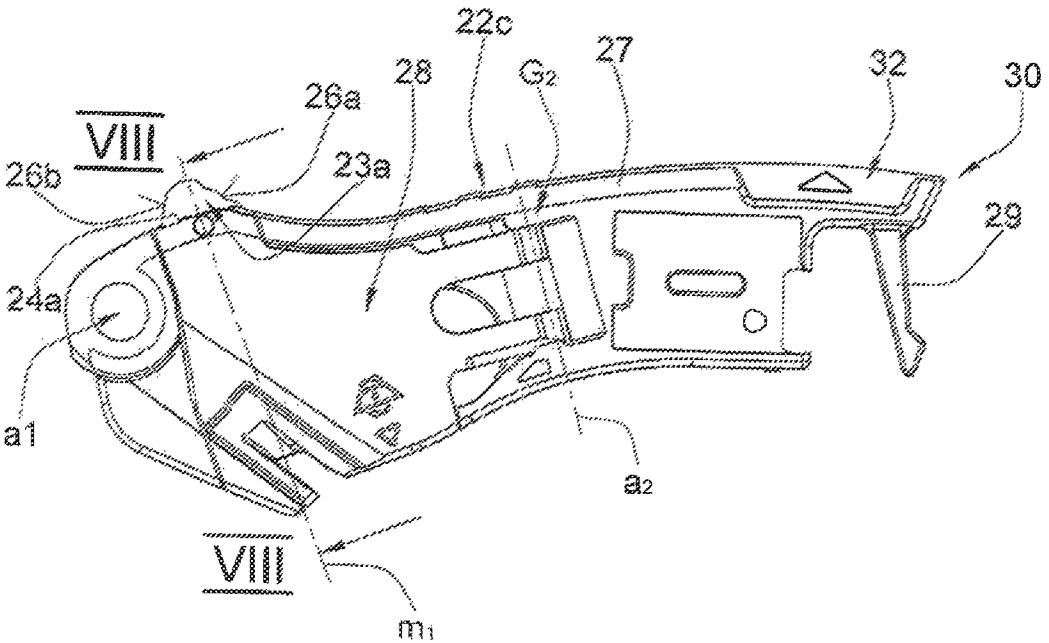
FIG. 7 is a side view of the holder, together with the cover

FIG. 7 is based on FIG. 4, with the only difference being that in FIG. 7 the cover 28 is shown in the closed position. FIGS. 8 and 9 show that an outer surface 48 of the tool 24*a* bears against a retaining surface 49 of the cover 28. The parts 23*a* and 23*b* of the tool 24 are held between the retaining surface 49 and the surface 44 of the holder 27, so that movement in the directions z1 and z2 is prevented. In this manner, the tool 24*a* cannot move out of the tool seat 39.

The invention claimed is:

1. A knife comprising:

a knife body forming a cavity;

a blade with a cutting edge;

a holder forming a tool seat and movable relative to the knife body between an operating position with the tool seat in the cavity and a change position with the tool seat outside the cavity; and a tool having at least two working parts and provided with a holding part that, in at least two different relative positions, can be fitted to the tool seat such that, in the operating position of the holder, one of the two working parts is fixable relative to the tool seat in a working position in which it projects from the body and can be used by a user while the other working part is in a stowed position inaccessible in the cavity and, in the change position, the tool is entirely outside the body and can be separated from the seat.

2. The knife in accordance with claim 1, wherein the tool is formed of sheet metal.

3. The knife in accordance with claim 1, wherein at least one of the working parts has at least one scoring edge.

4. The knife in accordance with claim 1, wherein the working parts of the tool are opposite one another and flank the holding part.

5. The knife in accordance with claim 1, wherein the holding part has a projection that fits complementarily with a recess of the seat.

6. The knife in accordance with claim 1, wherein the tool is held between a contact surface of the tool seat and a retaining surface of a cover of the body.

7. The knife in accordance with claim 1, wherein the holder also forms a blade seat holding the blade, and in the operating position the blade is held in the cavity with a portion of the cutting edge exposed and in the change position the blade is fully outside the cavity and separable from the holder.

8. The knife in accordance with claim 1, wherein the holding part of the tool is engageable in the two different relative positions in the seat in one of which one of the working parts is exposed in the operating position of the holder and in the other of which the other of the working parts is exposed in the operating position of the holder.

9. The knife in accordance with claim 8, wherein the working parts of the tool are the same shape.

10. A knife comprising:

a knife body forming a cavity;

a blade with a cutting edge;

a holder movable relative to the knife body and forming a tool seat;

a tool detachably held on the knife body, having at least two working parts, and provided with a holding part that, in at least two different relative positions, can be fitted to the tool seat such that either one of the working parts can be in a working position projecting from the body and can be used by a user while the other working part is in a stowed position inaccessible in the cavity; and a pivot on the knife body and carrying the holder such that the holder can pivot between an operating position and a change position.

11. The knife in accordance with claim 10, wherein the holding part of the tool is engageable in the two different relative positions in the seat in one of which one of the working parts is exposed in the operating position of the holder and in the other of which the other of the working parts is exposed in the operating position of the holder.

* * * * *